US010416696B2

(12) United States Patent
Chen et al.

(10) Patent No.: US 10,416,696 B2
(45) Date of Patent: Sep. 17, 2019

(54) LOW DROPOUT VOLTAGE REGULATOR

(71) Applicant: RichWave Technology Corp., Taipei (TW)

(72) Inventors: Chih-Sheng Chen, Taipei (TW); Tien-Yun Peng, Taipei (TW)

(73) Assignee: RichWave Technology Corp., Taipei (TW)

( * ) Notice: Subject to any disclaimer, the term of this patent is extended or adjusted under 35 U.S.C. 154(b) by 0 days.

(21) Appl. No.: 16/191,355

(22) Filed: Nov. 14, 2018

(65) Prior Publication Data

US 2019/0163220 A1 May 30, 2019

(30) Foreign Application Priority Data

Nov. 28, 2017 (TW) ..... 106141387 A

(51) Int. Cl.

| | |
|---|---|
| ***G05F 1/59*** | (2006.01) |
| ***G05F 1/575*** | (2006.01) |
| ***G05F 1/595*** | (2006.01) |
| ***G05F 1/569*** | (2006.01) |
| ***G05F 1/46*** | (2006.01) |

(52) U.S. Cl.

CPC ..... *G05F 1/575* (2013.01); *G05F 1/462* (2013.01); *G05F 1/569* (2013.01); *G05F 1/59* (2013.01); *G05F 1/595* (2013.01)

(58) Field of Classification Search

CPC ..... G05F 1/462; G05F 1/569; G05F 1/575; G05F 1/59; G05F 1/595

See application file for complete search history.

(56) References Cited

U.S. PATENT DOCUMENTS

| | | | | |
|---|---|---|---|---|
| 5,578,916 | A * | 11/1996 | Muterspaugh | G05F 1/573 323/267 |
| 6,703,813 | B1 | 3/2004 | Vladislav | |
| 7,030,699 | B2 | 4/2006 | Richard | |
| 7,821,240 | B2 * | 10/2010 | Oddoart | G05F 1/565 323/269 |
| 10,152,072 | B1 * | 12/2018 | Elhebeary | G05F 1/59 |
| 2004/0257151 | A1 * | 12/2004 | Chan | G05F 3/24 327/540 |

(Continued)

FOREIGN PATENT DOCUMENTS

| | | |
|---|---|---|
| TW | 201414190 A | 4/2014 |
| TW | 201606472 A | 2/2016 |

*Primary Examiner* — Yusef A Ahmed
*Assistant Examiner* — Ishrat F Jamali
(74) *Attorney, Agent, or Firm* — Winston Hsu

(57) ABSTRACT

A power supply device includes an input terminal, a regulated voltage output terminal, a switch, a first transistor, and a current split circuit. The input terminal receives a first control voltage. The regulated voltage output terminal outputs an output voltage. The switch has a first terminal coupled to the input terminal, a second terminal, and a control terminal. The first transistor has a first terminal coupled to a voltage terminal, a second terminal coupled to the regulated voltage output terminal, and a control terminal coupled to the second terminal of the switch. The current split circuit is coupled to the voltage terminal and the regulated voltage output terminal. The current split circuit receives the first control voltage or a second control voltage, and includes a second transistor coupled between the voltage terminal and the regulated voltage output terminal.

20 Claims, 5 Drawing Sheets

(56) References Cited

U.S. PATENT DOCUMENTS

| | | | | |
|---|---|---|---|---|
| 2009/0096531 | A1 | 4/2009 | Shimamoto | |
| 2009/0322297 | A1* | 12/2009 | Shiota | G05F 1/59 323/282 |
| 2013/0285631 | A1 | 10/2013 | Bisson | |
| 2018/0299915 | A1* | 10/2018 | Chen | H03F 1/0211 |

* cited by examiner

LOW DROPOUT VOLTAGE REGULATOR

CROSS REFERENCE TO RELATED APPLICATION

This application claims priority of Taiwan application No. 106141387, which was filed on Nov. 28, 2017, and is included herein by reference.

TECHNICAL FIELD

This invention is related to a low dropout voltage regulator, and more particularly, to a low dropout voltage regulator capable of protecting the internal transistor from breaking down.

BACKGROUND

In prior art, low dropout voltage regulators are commonly used to supply power for circuits. Therefore, in a low dropout voltage regulator, the transistor for outputting power has to endure great current loading, and has to be implemented with a great area. In addition, since the circuit may be switched between different operation modes, the output voltage and output current of the low dropout voltage regulators will also change. If the variations of the voltage and current are rather severe and exceed the safe operating area (SOA) of the transistor in the low dropout voltage regulator, then the transistor would break down, causing abnormal behavior of the low dropout voltage regulator and even damaging the low dropout voltage regulator.

For example, in the wireless communication application, the low dropout voltage regulator can provide power for the power amplifier. When the power amplifier is to be changed from a high power mode to a low power mode, the low dropout voltage regulator can lower its output voltage so the power of the power amplifier can be lowered accordingly. However, in this case, the cross voltage endured by the transistor in the low dropout voltage regulator will increase, and may exceed the SOA of the transistor easily, causing instability to the system.

SUMMARY

One embodiment of the present invention discloses a low dropout voltage regulator. The low dropout voltage regulator includes an operational amplifier device, a power supply device, and a feedback circuit.

The operational amplifier device outputs a control voltage according to an input voltage. The power supply device includes an input terminal, a regulated voltage output terminal, a switch, a first transistor, and a current split circuit. The input terminal receives the control voltage. The regulated voltage output terminal outputs an output voltage. The switch has a first terminal coupled to the input terminal, a second terminal, and a control terminal. The first transistor has a first terminal coupled to a voltage terminal, a second terminal coupled to the regulated voltage output terminal, and a control terminal coupled to the second terminal of the switch. The current split circuit is coupled to the voltage terminal, the input terminal, and the regulated voltage output terminal, and includes a second transistor coupled between the voltage terminal and the regulated voltage output terminal. The feedback circuit is coupled to the regulated voltage output terminal and the operational amplifier device.

Another embodiment of the present invention discloses a low dropout voltage regulator. The low dropout voltage regulator includes an operational amplifier device, a power supply device, and a feedback circuit.

The operational amplifier device outputs at least a control voltage according to an input voltage. The power supply device includes an input terminal, a regulated voltage output terminal, a switch, a first transistor, and a current split circuit. The input terminal receives the control voltage. The regulated voltage output terminal outputs an output voltage. The switch has a first terminal coupled to the input terminal, a second terminal, and a control terminal. The first transistor has a first terminal coupled to a voltage terminal, a second terminal coupled to the regulated voltage output terminal, and a control terminal coupled to the second terminal of the switch. The current split circuit is coupled to the voltage terminal, the operational amplifier device, and the regulated voltage output terminal, and the current split circuit includes a second transistor coupled between the voltage terminal and the regulated voltage output terminal. The feedback circuit is coupled to the regulated voltage output terminal and the operational amplifier device.

Another embodiment of the present invention discloses a power supply device. The power supply device includes an input terminal, a regulated voltage output terminal, a switch, a first transistor, and a current split circuit.

The input terminal receives a first control voltage. The regulated voltage output terminal outputs an output voltage. The switch has a first terminal coupled to the input terminal, a second terminal, and a control terminal. The first transistor has a first terminal coupled to a voltage terminal, a second terminal coupled to the regulated voltage output terminal, and a control terminal coupled to the second terminal of the switch. The current split circuit is coupled to the voltage terminal and the regulated voltage output terminal. The current split circuit receives the first control voltage or a second control voltage, and includes a second transistor coupled between the voltage terminal and the regulated voltage output terminal.

DETAILED DESCRIPTION

Figure 1:
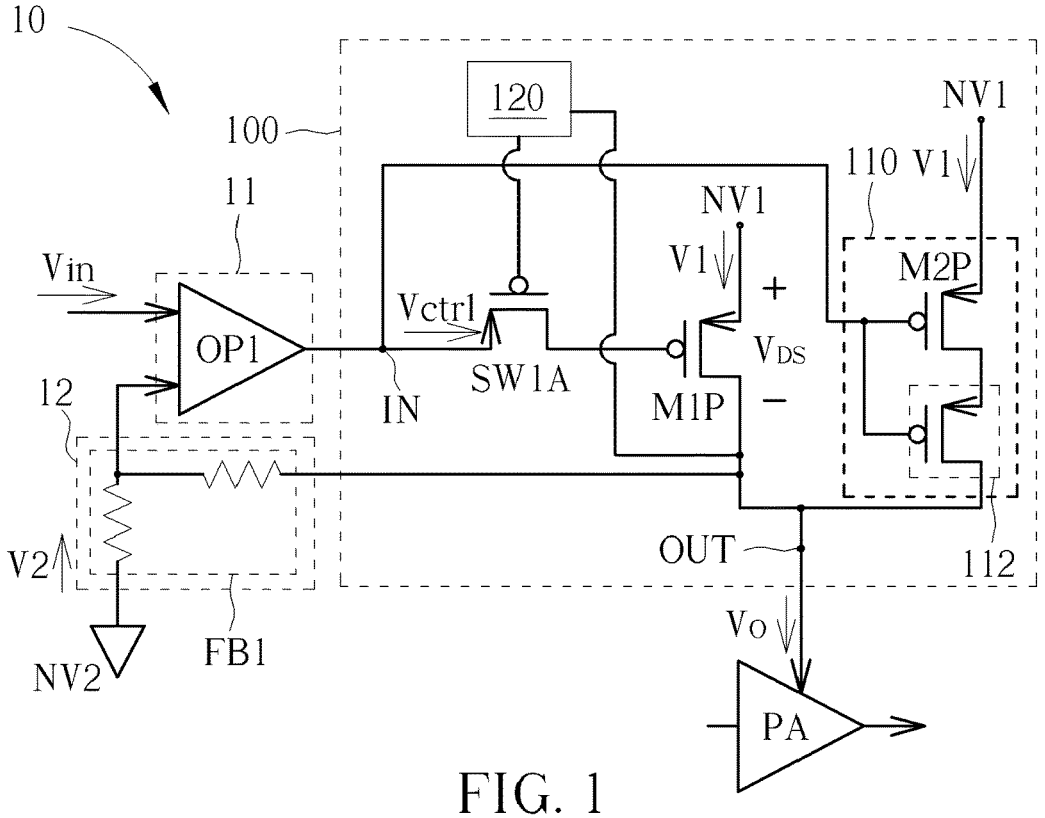
FIG. 1 shows a low dropout voltage regulator according to one embodiment of the present invention.

Below, exemplary embodiments will be described in detail with reference to accompanying drawings so as to be easily realized by a person having ordinary knowledge in the art. The inventive concept maybe embodied in various forms without being limited to the exemplary embodiments set forth herein. Descriptions of well-known parts are omitted for clarity, and like reference numerals refer to like elements throughout.

FIG. 1 shows a low dropout voltage regulator 10 according to one embodiment of the present invention. The low dropout voltage regulator 10 can include an operational amplifier device 11, a feedback circuit 12, and a power supply device 100.

The operational amplifier device 11 can output a control voltage Vctrl according to an input voltage Vin. In FIG. 1, the operational amplifier device 11 can include an operational amplifier OP1. The operational amplifier OP1 has a first input terminal, a second input terminal, and an output terminal. The first input terminal of the operational amplifier OP1 can receive the input voltage Vin, and the output terminal of the operational amplifier OP1 can output the control voltage Vctrl.

The power supply device 100 can include an input terminal IN, a regulated voltage output terminal OUT, a switch SW1A, a transistor M1P, and a current split circuit 110. The input terminal IN can be coupled to the output terminal of the operational amplifier OP1 in the operational amplifier device 11 to receive the control voltage Vctrl. The switch SW1A has a first terminal, a second terminal, and a control terminal. The first terminal of the switch SW1A can be coupled to the input terminal IN. The transistor M1P has a first terminal, a second terminal, and a control terminal. The first terminal of the transistor M1P is coupled to a voltage terminal NV1, the second terminal of the transistor M1P is coupled to the regulated voltage output terminal OUT, and the control terminal of the transistor M1P is coupled to the second terminal of the switch SW1A. The current split circuit 110 is coupled to the voltage terminal NV1, the input terminal IN, and the regulated voltage output terminal OUT. The current split circuit 110 includes a transistor M2P coupled between the voltage terminal NV1 and the regulated voltage output terminal OUT. A voltage V1 provided by the voltage terminal NV1 can be a high voltage in the system, such as a battery voltage in the system.

In FIG. 1, the current split circuit 110 can further include a voltage drop element 112. The transistor M2P has a first terminal, a second terminal, and a control terminal. The first terminal of the transistor M2P is coupled to the voltage terminal NV1, and the control terminal of the transistor M2P is coupled to the input terminal IN for receiving the control voltage Vctrl outputted by the operational amplifier OP1 of the operational amplifier device 11. The voltage drop element 112 has a first terminal and a second terminal. The first terminal of the voltage drop element 112 is coupled to the second terminal of the transistor M2P, and the second terminal of the voltage drop element 112 is coupled to the regulated voltage output terminal OUT. In FIG. 1, the voltage drop element 112 can be implemented by a transistor. The voltage drop element 112 further includes a control terminal, and the control terminal of the voltage drop element 112 can be coupled to the control terminal of the transistor M2P.

The regulated voltage output terminal OUT can output the output voltage Vo, and the feedback circuit 12 can be coupled to the regulated voltage output terminal OUT and the operational amplifier device 11. The feedback circuit 12 includes a feedback unit FB1 coupled to the regulated output terminal OUT, the second input terminal of the operational amplifier OP1, and a voltage terminal NV2. A voltage V2 provided by the voltage terminal NV2 can be a low voltage or a ground voltage in the system.

In some embodiments of the present invention, the output voltage Vo outputted by the low dropout voltage regulator 10 can be provided to other circuits as a power supply, and the low dropout voltage regulator 10 can choose the internal paths for outputting the output voltage Vo according to the condition of the circuit receiving the output voltage Vo.

Figure 2:
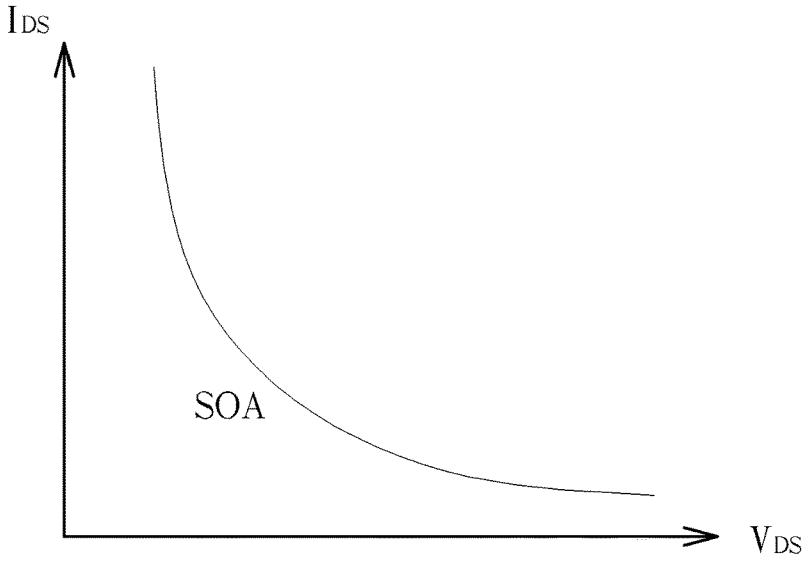
FIG. 2 shows a safe operating area of the first transistor of the low dropout voltage regulator in FIG. 1.

For example, in FIG. 1, the output voltage Vo outputted by the low dropout voltage regulator 10 can be provided to the power amplifier PA as a power supply. When the power amplifier PA operates in a high power mode, the low dropout voltage regulator 10 would provide a higher output voltage Vo, for example, the output voltage Vo may be close to the voltage V1 provided by the voltage terminal NV1. In this case, since the first terminal of the transistor M1P is coupled to the voltage terminal NV1, the cross voltage $V_{DS}$ between the first terminal and the second terminal of the transistor M1P is rather small. FIG. 2 shows a safe operating area (SOA) of the transistor M1P. According to FIG. 2, when the cross voltage $V_{DS}$ between the first terminal and the second terminal of the transistor M1P is rather small, the transistor M1P is able to provide a greater current $I_{DS}$ within the SOA without breaking down. Therefore, when the cross voltage $V_{DS}$ between the first terminal and the second terminal of the transistor M1P is rather small, the switch SW1A can be turned on, so the transistor M1P would receive the control voltage Vctrl to produce the output voltage Vo. That is, in this case, the output voltage Vo is mainly provided by the transistor M1P.

Contrarily, when the power amplifier PA operates in a low power mode, the low dropout voltage regulator 10 would provide a lower output voltage Vo, which can be as low as the low voltage or the ground voltage of the system. For example, if the voltage V1 provided by the voltage terminal NV1 is the battery voltage at 4.2V, then the output voltage Vo provided by the low dropout voltage regulator 10 can be about 0.2V when operating in the low power mode. Since the first terminal of the transistor M1P is coupled to the voltage terminal NV1, the cross voltage $V_{DS}$ between the first terminal and the second terminal of the transistor M1P would be about 4V. However, as shown in FIG. 2, when the cross voltage $V_{DS}$ of the transistor M1P is rather large, the transistor M1P may only generate a small current, otherwise, the transistor M1P may be outside its SOA, breaking down the transistor M1P.

In addition, in a common manufacturing process, the breakdown voltage of the transistor M1P might be 1.8V or 3.3V. In this case, if the output voltage Vo is outputted by the transistor M1P, making the transistor M1P to generate current when the cross voltage $V_{DS}$ is 4V, then the transistor M1P might breakdown, causing instability to the system. Therefore, when the cross voltage $V_{DS}$ of the transistor M1P is rather large, the switch SW1A can be turned off, and the output voltage Vo would be outputted by the current split circuit 110. Since the current split circuit 110 includes the transistor M2P and the voltage drop element 112, these two elements can endure part of the cross voltage respectively, refraining the transistor M2P from breaking down.

Also, since the output current is smaller when the output voltage Vo is smaller, the channel width-to-length ratio of the transistor M2P can be smaller than the channel width-to-length ratio of the transistor M1P for reducing the area required by the power supply device 100. In some embodiments, the channel width-to-length ratio of the transistor M1P can be 10 times greater than the channel width-to-length ratio of the transistor M2P. However, the size of the transistors can be decided according to the system requirement in other embodiments.

In some embodiments, the power supply device 100 can set up the endurable threshold of the transistor M1P according to its SOA, and the endurable threshold can be determined to be smaller than the breakdown voltage of the transistor M1P, ensuring the transistor M1P to operate in the SOA. When operating, the cross voltage $V_{DS}$ between the first terminal and the second terminal of the transistor M1P can be compared with the endurable threshold of the transistor M1P as the base to control the switch SW1A. That is, the power supply device 100 can turn off the switch SW1A and output the output voltage Vo through the current split circuit 110 when the cross voltage $V_{DS}$ between the first terminal and the second terminal of the transistor M1P is greater than the endurable threshold of the transistor M1P. Also, the power supply device 100 can turn on the switch SW1A and output the output voltage Vo through the transistor M1P when the cross voltage $V_{DS}$ between the first terminal and the second terminal of the transistor M1P is smaller than the endurable threshold of the transistor M1P. In this case, although the split current 110 may continue to generate the output voltage Vo, the output voltage Vo would still be outputted mainly by the transistor M1P due to the larger effective conducting resistance of the transistor M2P. Namely, in this case, the output voltage Vo would be outputted at least by the transistor M1P.

Furthermore, since the first terminal of the transistor M1P is coupled to the voltage terminal NV1 for receiving a fixed system voltage, the cross voltage $V_{DS}$ endured by the transistor M1P can be derived by detecting the voltage at the second terminal of the transistor M1P, that is, by detecting the output voltage Vo, in some embodiments. For example, in FIG. 1, the power supply device 100 can further include a control circuit 120. The control circuit 120 can determine whether the cross voltage $V_{DS}$ of the transistor M1P is greater than the endurable threshold of the transistor M1P according to the voltage at the second terminal of the transistor M1P, that is, the output voltage Vo, and control the switch SW1A accordingly.

Also, the output voltage Vo of the low dropout voltage regulator 10 is related to the input voltage Vin of the operational amplifier device 11, for example, the ratio of the output voltage Vo and the input voltage Vin is usually fixed. In this case, the control circuit 120 can also derive the cross voltage $V_{DS}$ endured by the transistor M1P by detecting to the input voltage Vin, and use a comparator to compare the relation between the cross voltage $V_{DS}$ of the transistor M1P and the endurable threshold of the transistor M1P for controlling the switch SW1A.

Since the power supply device 100 can control the internal path for generating the output voltage Vo according to the cross voltage $V_{DS}$ of the transistor M1P, the current split circuit 110 can be used to generate the output voltage Vo when the output voltage Vo is rather low and the cross voltage $V_{DS}$ of the transistor M1P is too high, protecting the transistor M1P from falling out of the SOA and breaking down, and improving the system stability.

In FIG. 1, the control circuit 120 can derive the cross voltage $V_{DS}$ of the transistor M1P by detecting the output voltage Vo, however, in some other embodiments, since the current flowing through the regulated voltage output terminal OUT, that is, the output current, is also related to the output voltage Vo, the control circuit 120 may also use the current flowing through the regulated voltage output terminal OUT for determination and control.

Figure 3:
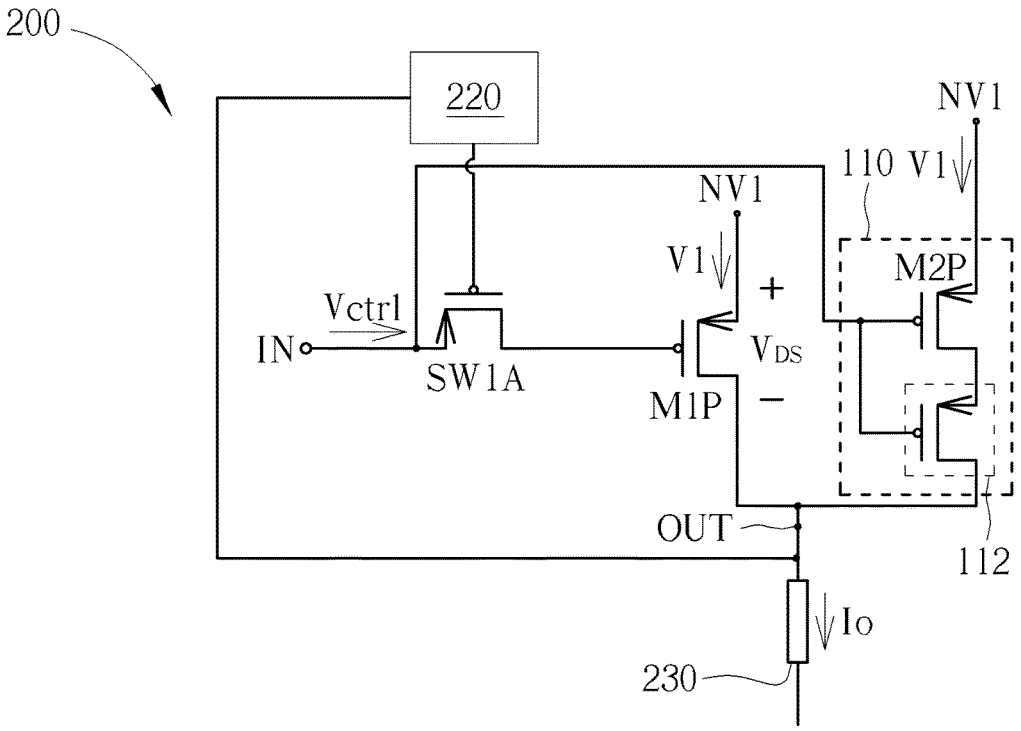
FIG. 3 shows a power supply device according to another embodiment of the present invention.

FIG. 3 shows the power supply device 200 according to another embodiment of the present invention. The power supply devices 100 and 200 have similar structures and can be operated by similar principles. However, the power supply device 200 further includes a current detection element 230. The current detection element 230 can transform the output current Io flowing through the regulated voltage output terminal OUT into a voltage signal. Consequently, the control circuit 220 would be able to determine the status of the transistor M1P according to the intensity of the output current Io, and to turn on or turn off the switch SW1A accordingly, ensuring the transistor M1P to operate in its SOA.

For example, the user can determine the threshold according to the SOA of the transistor M1P and the relation between the output current Io and the output voltage Vo. When the current flowing through the regulated voltage output terminal OUT, that is, the output current Io, is greater than the threshold, the control circuit 220 would turn on the switch SW1A so the output voltage Vo would be outputted mainly by the transistor M1P. When the current flowing through the regulated voltage output terminal OUT is smaller than the threshold, the control circuit 220 would turn off the switch SW1A so the output voltage Vo would be outputted by the current split circuit 110.

Figure 4:
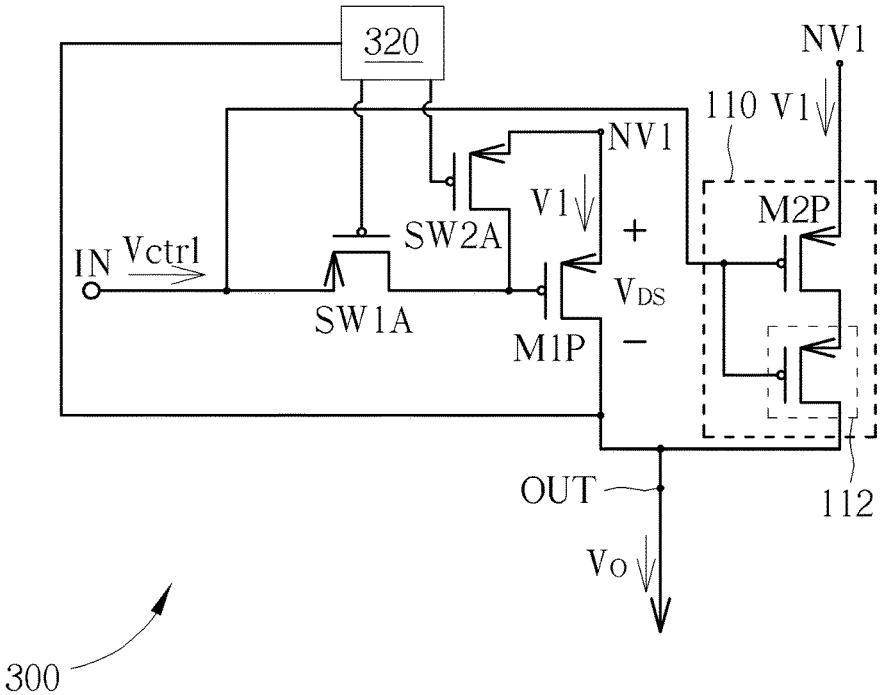
FIG. 4 shows a power supply device according to another embodiment of the present invention.

In FIG. 1, the transistor M1P can be a P-type transistor. To ensure the transistor M1P will not generate current when the switch SW1A is turned off, the power supply device 100 can further include other switches for controlling the circuit in some embodiments. FIG. 4 shows a power supply device 300 according to another embodiment of the present invention. The power supply devices 100 and 300 have similar structures and can be operated by similar principles. However, the power supply device 300 further includes a switch SW2A. The switch SW2A has a first terminal, a second terminal, and a control terminal. The first terminal of the switch SW2A is coupled to the voltage terminal NV1, the second terminal of the switch SW2A is coupled to the control terminal of the transistor M1P. When the cross voltage $V_{DS}$ between the first terminal and the second terminal of the transistor M1P is greater than the endurable threshold of the transistor M1P, the switch SW1A would be turned off and the switch SW2A would be turned on. Therefore, the control terminal of the transistor M1P would be coupled to the voltage terminal NV1 through the switch SW2A, and will not be turned on unexpectedly due to being floating. Contrarily, when the cross voltage $V_{DS}$ of the transistor M1P is smaller than the endurable threshold of the transistor M1P, the switch SW1A would be turned on and the switch SW2A would be turned off.

In FIG. 4, the control terminal of the switch SW2A can be coupled to the control circuit 320. In other words, the control circuit 320 can control the switch SW1A and the switch SW2A at the same time. However, in other embodiments of the present invention, the switches SW1A and SW2A can also be controlled by different control circuits. That is, the control circuit 320 can control at least one of the switches SW1A and SW2A according to the system requirement.

Figure 5:
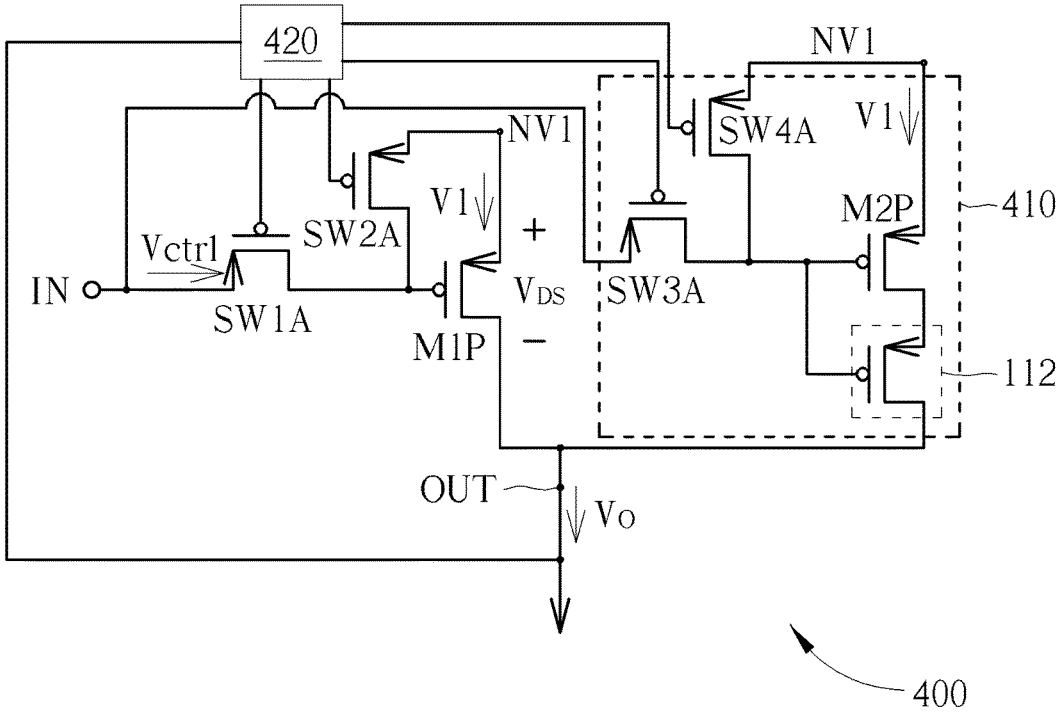
FIG. 5 shows a power supply device according to another embodiment of the present invention.

FIG. 5 shows a power supply device 400 according to another embodiment of the present invention. The power supply devices 300 and 400 have similar structures, and can be operated by similar principles. However, the current split circuit 410 of the power supply device 400 further includes a switch SW3A and a switch SW4A.

The switch SW3A has a first terminal, a second terminal, and a control terminal. The first terminal of the switch SW3A can be coupled to the input terminal IN for receiving the control voltage Vctrl outputted by the operational amplifier device 11, and the second terminal of the switch SW3A is coupled to the control terminal of the transistor M2P.

When the cross voltage $V_{DS}$ between the first terminal and the second terminal of the transistor M1P is greater than the endurable threshold of the transistor M1P, the switch SW3A would be turned on. In this case, the output voltage Vo would be generated by the current split circuit 410. When the cross voltage $V_{DS}$ of the transistor M1P is smaller than the endurable threshold of the transistor M1P, the switch SW3A would be turned off. In this case, the output voltage Vo would be generated by the transistor M1P.

The switch SW4A has a first terminal, a second terminal, and a control terminal. The first terminal of the switch SW4A can be coupled to the voltage terminal NV1, and the second terminal of the switch SW4A is coupled to the control terminal of the transistor M2P. In FIG. 5, the transistor M2P is a P-type transistor. Therefore, when the cross voltage $V_{DS}$ of the transistor M1P is smaller than the endurable threshold of the transistor M1P, the switch SW4A would be turned on. In this case, the control terminal of the transistor M2P would be fixed at the voltage V1 provided by the voltage terminal NV1, so the transistor M2P would not be turned on unexpectedly due to being floating. Contrarily, when the cross voltage $V_{DS}$ of the transistor M1P is greater than the endurable threshold of the transistor M1P, the switch SW4A would be turned off. In other words, when the transistor M1P is turned on, the transistor M2P would be turned off.

In FIG. 5, the control terminals of the switches SW1A, SW2A, SW3A, and SW4A can all be coupled to the control circuit 420. In other words, the control circuit 420 can control the switches SW1A, SW2A, SW3A, and SW4A at the same time. However, in other embodiments of the present invention, the switches SW1A, SW2A, SW3A, and SW4A can also be controlled by different control circuits. That is, the control circuit 420 can control at least one of the switches SW1A, SW2A, SW3A, and SW4A according to the system requirement. Also, in some embodiments of the present invention, the power supply device 400 can remove the switches SW2A and SW4A according to the system requirement. In this case, the control circuit 420 can control at least one of the switches SW1A and SW3A.

In addition, the control circuit 420 can be aware of the cross voltage $V_{DS}$ of the transistor M1P according to the output voltage Vo and compare the cross voltage $V_{DS}$ of the transistor M1P with the endurable threshold of the transistor M1P for controlling the switches as the control circuit 120 shown in FIG. 1. However, in other embodiments, the control circuit 420 can also detect the cross voltage $V_{DS}$ of the transistor M1P directly and compare the cross voltage $V_{DS}$ of the transistor M1P with the endurable threshold of the transistor M1P, or the control circuit 420 can control the switches by sensing the output current Io as done by the control circuit 220 shown in FIG. 3.

In the embodiments in FIGS. 1 and 3 to 5, the voltage drop element 112 can be implemented by a transistor. However, in other embodiments, the voltage drop element 112 can also include at least one transistor, a resistor, at least one diode, at least one diode-connected transistor, or any combinations of the four aforementioned items. In addition, connection order of the voltage drop element 112 and the transistor M2P can be changed.

Figure 6:
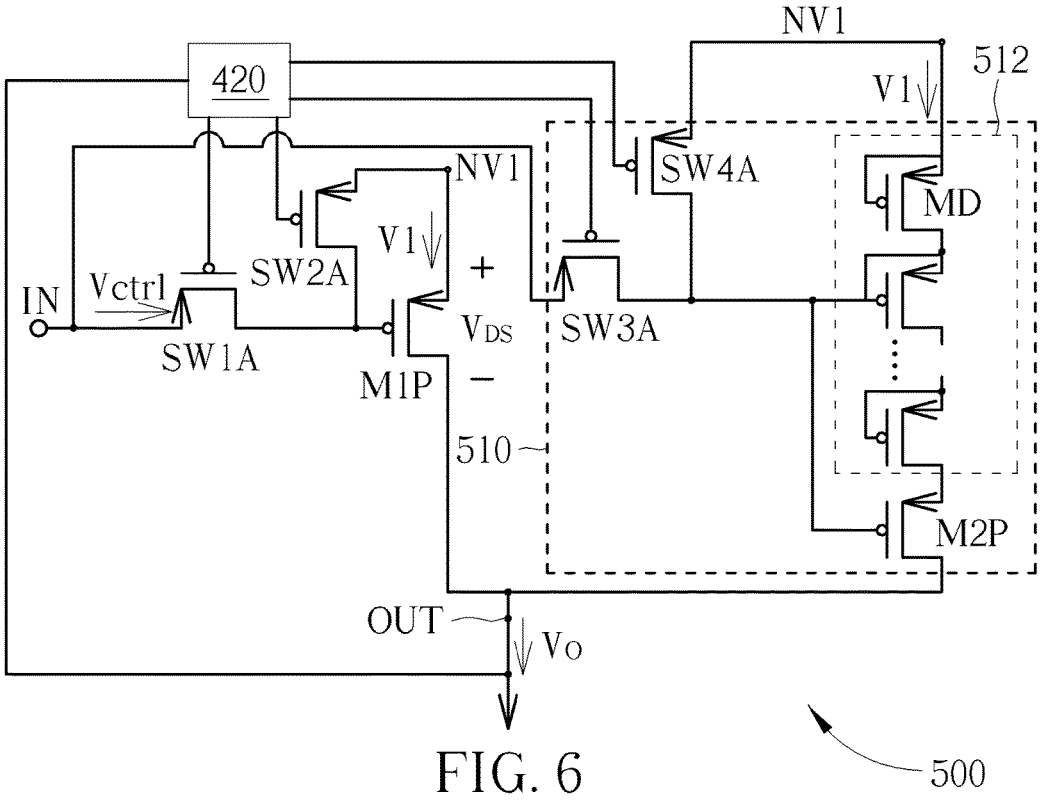
FIG. 6 shows a power supply device according to another embodiment of the present invention.

FIG. 6 shows a power supply device 500 according to another embodiment of the present invention. The power supply devices 400 and 500 have similar structures and can be operated by similar principles. However, in the power supply device 500, the current split circuit 510 can include a transistor M2P, a voltage drop element 512, a switch SW3A and a switch SW4A. The voltage drop element 512 has a first terminal and a second terminal. The first terminal of the voltage drop element 512 is coupled to the voltage terminal NV1. The transistor M2P has a first terminal, a second terminal, and a control terminal. The first terminal of the transistor M2P is coupled to the second terminal of the voltage drop element 512, the second terminal of the transistor M2P is coupled to the regulated voltage output terminal OUT, and the control terminal of the transistor M2P can be coupled to the input terminal IN through the switch SW3A.

In addition, in FIG. 6, the voltage drop element 512 can include N diode-connected transistors MD coupled in series, where N is an integer and N≥2. In other embodiments, the diode-connected transistors MD in the voltage drop element 512 can be replaced by diodes. Or, the voltage drop element 512 can further include resistors or transistors, or the combination of at least one of the resistor, the transistor, the diode, and the diode-connected transistor.

Figure 7:
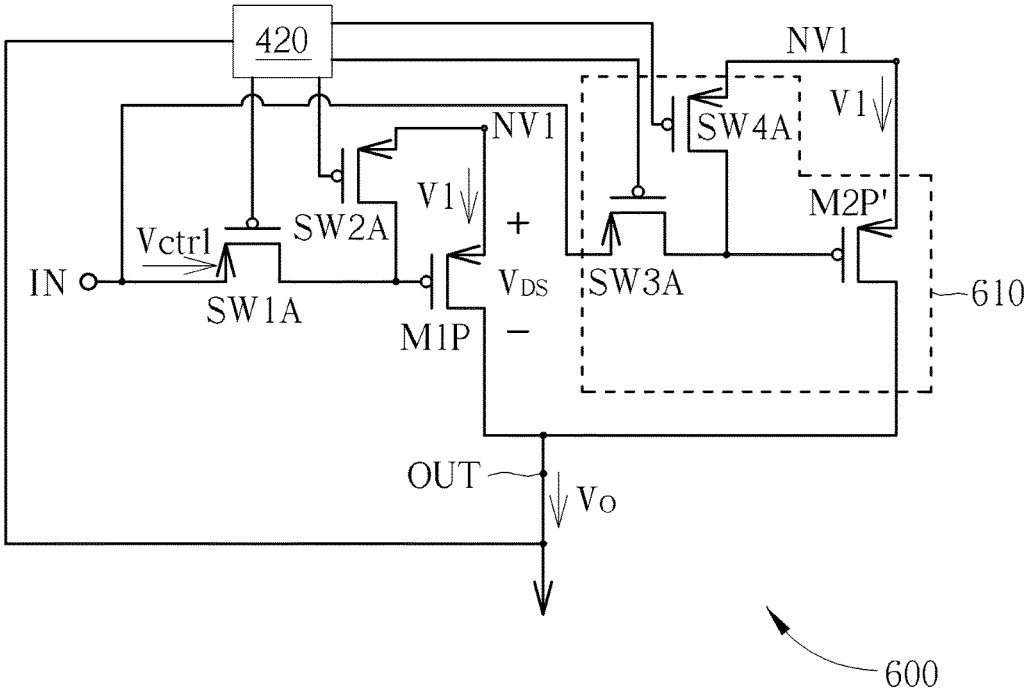
FIG. 7 shows a power supply device according to another embodiment of the present invention.

In addition, in some embodiments, the voltage drop elements 112 and 512 can be omitted. FIG. 7 shows a power supply device 600 according to another embodiment of the present invention. The power supply devices 400 and 600 have similar structures and can be operated by similar principles. However, in the power supply device 600, although the current split circuit 610 includes a transistor M2P' and switches SW3A and SW4A, it does not include other voltage drop elements. In other words, the first terminal of the transistor M2P' is coupled to the voltage terminal NV1, the second terminal of the transistor M2P' is coupled to the regulated voltage output terminal OUT, and the control terminal of the transistor M2P' can be coupled to the input terminal IN through the switch SW3A for receiving the control voltage Vctrl outputted by the operational amplifier device 11. However, the channel length of the transistor M2P' can be greater than the channel length of the transistor M1P. In other words, the conducting resistance of the transistor M2P' would be greater than the conducting resistance of the transistor M1P, and the transistor M2P' is able to endure a higher voltage drop.

Figure 8:
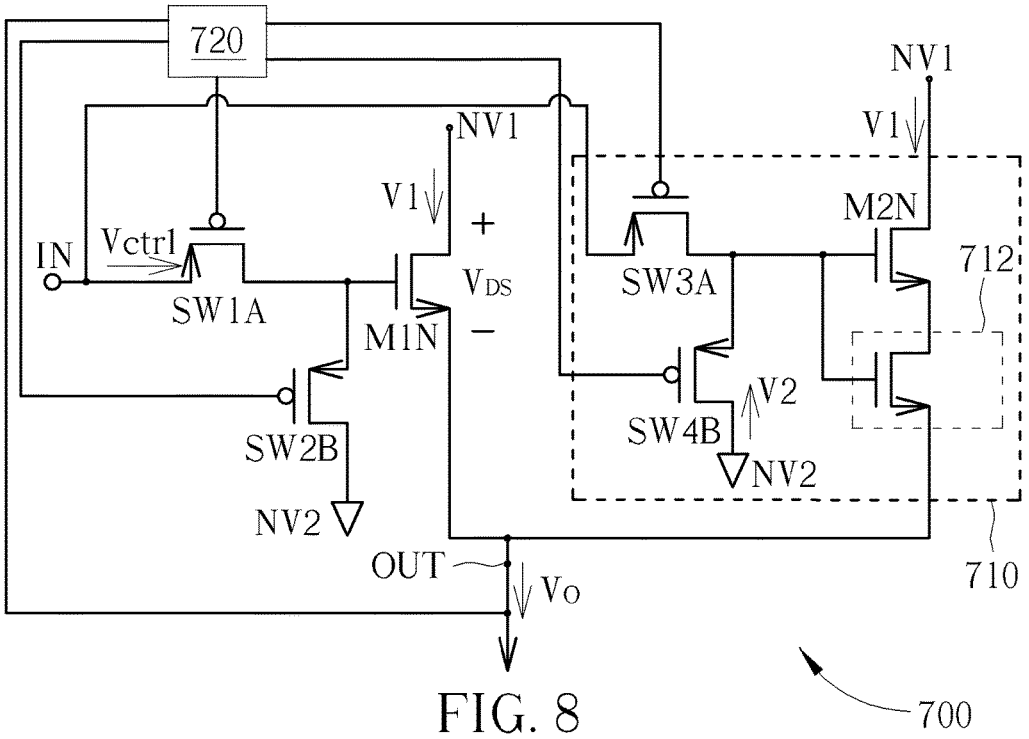
FIG. 8 shows a power supply device according to another embodiment of the present invention.

In the embodiments shown in FIGS. 1 and 3 to 7, the transistors M1P, M2P or M2P' are all P-type transistors. However, in other embodiments of the present invention, the user can also implement the transistors M1P, M2P or M2P' with N-type transistors. FIG. 8 shows a power supply device 700 according to another embodiment of the present invention. The power supply devices 400 and 700 have similar structures, and can be operated by similar principles. However, in the power supply device 700, the transistor M1N, the transistor M2N in the current split circuit 710, and the voltage drop element 712 are all implemented by N-type transistors.

In this case, the switches SW2B and SW4B of the power supply device 700 would be coupled to the voltage terminal NV2 providing the lower voltage. That is, the first terminal of the switch SW2B can be coupled to the voltage terminal NV2, and the second terminal of the switch SW2B can be coupled to the control terminal of the transistor M1N. Also, the voltage V2 provided by the voltage terminal NV2 can be the ground voltage of the system. Consequently, when the cross voltage $V_{DS}$ between the first terminal and the second terminal of the transistor MIN is greater than the endurable threshold of the transistor M1N, the switch SW1A would be turned off, and the switch SW2B would be turned on. Therefore, the control terminal of the transistor MIN would receive the voltage V2, and the transistor MIN will not be turned on unexpectedly due to being floating. Furthermore, when the cross voltage $V_{DS}$ of the transistor MIN is smaller than the endurable threshold of the transistor M1N, the switch SW1A would be turned on, and the switch SW2B would be turned off.

Similarly, the first terminal of the switch SW4B can be coupled to the voltage terminal NV2, and the second terminal of the switch SW4B can be coupled to the control terminal of the transistor M2N. When the cross voltage $V_{DS}$ of the transistor MIN is smaller than the endurable threshold of the transistor M1N, the switch SW3A would be turned off, and the switch SW4B would be turned on. Therefore, the control terminal of the transistor M2N would receive the voltage V2, and the transistor M2N will not be turned on unexpectedly due to being floating. Also, when the cross voltage $V_{DS}$ of the transistor MIN is greater than the endurable threshold of the transistor M1N, the switch SW3A would be turned on, and the switch SW4B would be turned off.

In FIG. 8, the control terminals of the switches SW1A, SW2B, SW3A, and SW4B can be coupled to the control circuit 720. In other words, the control circuit 720 can control the switches SW1A, SW2B, SW3A, and SW4B at the same time. However, in other embodiments of the present invention, the switches SW1A, SW2B, SW3A, and SW4B can also be controlled by different control circuits. That is, the control circuit 720 can control at least one of the switches SW1A, SW2B, SW3A, and SW4B according to the system requirement. Also, in some embodiments of the present invention, the power supply device 700 can remove the switches SW2B and SW4B according to the system requirement. In this case, the control circuit 720 can control at least one of the switches SW1A and SW3A.

In addition, the control circuit 720 can derive the cross voltage $V_{DS}$ of the transistor MIN according to the output voltage Vo as the control circuit 120 shown in FIG. 1, and compare the cross voltage $V_{DS}$ of the transistor MIN with the endurable threshold of the transistor MIN for controlling the switches. However, in other embodiments, the control circuit 720 can also detect the cross voltage $V_{DS}$ of the transistor MIN directly and compare the cross voltage $V_{DS}$ of the transistor MIN with the endurable threshold of the transistor M1N, or the control circuit 720 can control the switches by sensing the output current Io as done by the control circuit 220 shown in FIG. 3.

Figure 9:
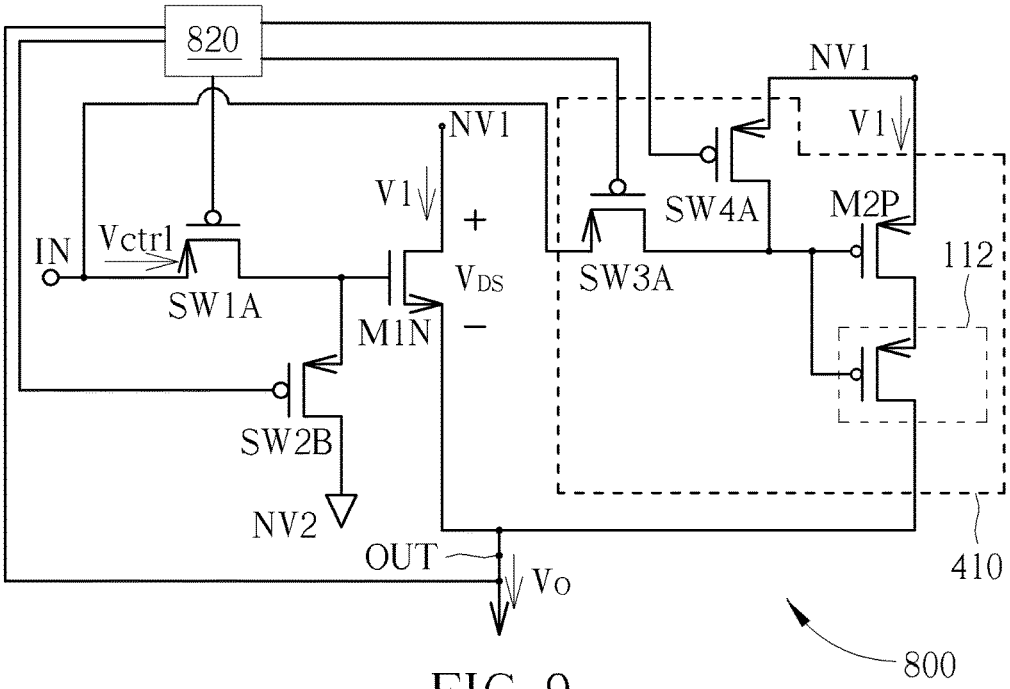
FIG. 9 shows a power supply device according to another embodiment of the present invention.

In addition, the present invention is not limited to implementing the transistors M1P, M2P or M2P' with the same type of transistors. FIG. 9 shows a power supply device 800 according to another embodiment of the present invention. The power supply devices 400 and 800 have similar structures, and can be operated by similar principles. However, in the power supply device 800, the transistor MIN is an N-type transistor, and the transistor M2P is a P-type transistor. Generally, the P-type transistor can endure greater voltage than the N-type transistor, and the N-type transistor has smaller conducting resistance than the P-type transistor. Therefore, when the cross voltage $V_{DS}$ of the transistor MIN is smaller than the endurable threshold of the transistor M1N, the switch SW1A would be turned on, the switch SW3A would be turned off, and the power supply device 800 can output the output voltage Vo through the transistor M1N. However, when the cross voltage $V_{DS}$ between the first terminal and the second terminal of the transistor M1N is greater than the endurable threshold of the transistor M1N, the switch SW1A would be turned off, the switch SW3A would be turned on, and the power supply device 800 can output the output voltage Vo through the transistor M2P having better voltage endurability in the current split circuit 410.

Since the power supply device 800 can control the internal path for generating the output voltage Vo according to the cross voltage $V_{DS}$ of the transistor M1N, the power supply device 800 can use the current split circuit 410 to generate the output voltage Vo when the output voltage Vo is rather low and the cross voltage $V_{DS}$ of the transistor MIN is rather high, protecting the transistor MIN from falling out of the SOA and breaking down, and improving the system stability.

In the embodiment shown in FIG. 9, the control terminals of the switches SW1A, SW2B, SW3A, and SW4A can be coupled to the control circuit 820. In other words, the control circuit 820 can control the switches SW1A, SW2B, SW3A, and SW4A at the same time. However, in other embodiments of the present invention, the switches SW1A, SW2B, SW3A, and the SW4A can also be controlled by different control circuits. That is, the control circuit 820 can control at least one of the switches SW1A, SW2B, SW3A, and SW4A according to the system requirement. Also, in some embodiments of the present invention, the power supply device 800 can remove the switches SW2B and SW4A according to the system requirement. In this case, the control circuit 820 can control at least one of the switches SW1A and the SW3A.

The power supply devices 200 to 800 shown in FIGS. 3 to 9 can be applied to the low dropout voltage regulator 10 shown in FIG. 1 for replacing the power supply device 100. However, in other embodiments, the power supply devices 100 to 800 can also be applied to other different circuits, and can switch their internal paths for outputting the output voltage according to their output voltages or output currents.

In addition, in the low dropout voltage regulator 10 in FIG. 1, the operational amplifier device 11 includes only one operational amplifier OP1, so the current split circuit 110 and the switch SW1A would receive the same control voltage Vctrl. However, in some other embodiments of the present invention, the operational amplifier device 11 can also include another operational amplifier, and the current split circuit can receive the control voltage generated by the another operational amplifier.

Figure 10:
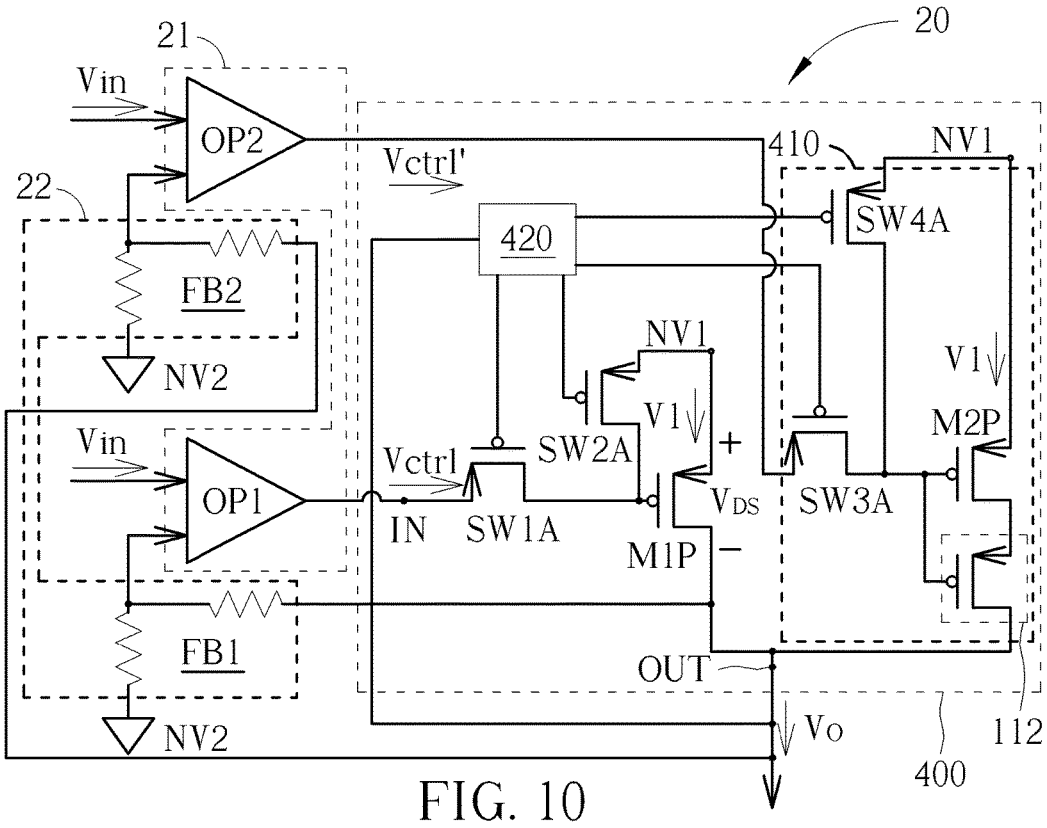
FIG. 10 shows a low dropout voltage regulator according to another embodiment of the present invention.

FIG. 10 shows a low dropout voltage regulator 20 according to another embodiment of the present invention. The low dropout voltage regulator 20 includes the operational amplifier device 21, the feedback circuit 22, and the power supply device 400.

The operational amplifier device 21 can include operational amplifiers OP1 and OP2. The operational amplifier OP1 has a first input terminal, a second input terminal, and an output terminal. The first input terminal of the operational amplifier OP1 can receive the input voltage Vin, and the output terminal of the operational amplifier OP1 can output the control voltage Vctrl. The operational amplifier OP2 has a first input terminal, a second input terminal, and an output terminal. The first input terminal of the operational amplifier OP2 can receive the input voltage Vin, and the output terminal of the operational amplifier OP2 can be coupled to the current split circuit 410. The output terminal of the operational amplifier OP2 can output the control voltage Vctrl' for controlling the current split circuit 410. The feedback circuit 22 can include the feedback units FB1 and FB2. The feedback unit FB1 is coupled to the regulated voltage output terminal OUT and the second input terminal of the operational amplifier OP1. The feedback unit FB2 is coupled to the regulated voltage output terminal OUT and the second input terminal of the operational amplifier OP2.

In other words, the operational amplifiers OP1 and OP2 can operate in the same status. That is, while the operational amplifier OP1 outputs the control voltage Vctrl to the control terminal of the transistor M1P, the operational amplifier OP2 can output the control voltage Vctrl' to the control terminal of the transistor M2P in the current split circuit 410. The feedback unit FB1 can be used to provide the feedback signal for the operational amplifier OP1 to stabilize the control voltage Vctrl generated by the operational amplifier OP1, and the feedback unit FB2 can be used to provide the feedback signal for the operational amplifier OP2 to stabilize the control voltage Vctrl' generated by the operational amplifier OP2.

Consequently, when the power supply device 400 activates the current split circuit 410 and uses the transistor M2P to generate the output voltage Vo, the operational amplifier OP1 will not be affected, improving the stability of the system.

Furthermore, in the embodiments shown in FIGS. 1 and 3 to 10, the switches SW1A, SW2A, SW2B, SW3A, SW4A and SW4B can be implemented by transistors, such as N-type transistors or P-type transistors, or can be implemented by other electronic components according to the system requirement.

In summary, the power supply devices and the low dropout voltage regulators provided by the embodiments of the present invention can provide power to external circuits, and adjust internal voltage generating paths according to the status of the external circuits, protecting the internal transistors from breaking down by high cross voltages, and improving the stability of the system.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A low dropout voltage regulator comprising:

an operational amplifier device configured to output a control voltage according to an input voltage, a power supply device comprising:

an input terminal configured to receive the control voltage;

a regulated voltage output terminal configured to output an output voltage;

a first switch having a first terminal coupled to the input terminal, a second terminal, and a control terminal;

a first transistor having a first terminal coupled to a first voltage terminal, a second terminal coupled to the regulated voltage output terminal, and a control terminal coupled to the second terminal of the first switch; and a current split circuit coupled to the first voltage terminal, the input terminal, and the regulated voltage output terminal, and comprising a second transistor coupled between the first voltage terminal and the regulated voltage output terminal; and a feedback circuit coupled to the regulated voltage output terminal and the operational amplifier device.

2. The low dropout voltage regulator of claim 1, wherein:

when a cross voltage between the first terminal and the second terminal of the first transistor is greater than an endurable threshold of the first transistor, the first switch is turned off and the output voltage is outputted by the current split circuit; and when the cross voltage between the first terminal and the second terminal of the first transistor is smaller than the endurable threshold of the first transistor, the first switch is turned on and the output voltage is outputted at least by the first transistor.

3. The low dropout voltage regulator of claim 2, wherein the endurable threshold of the first transistor is smaller than a breakdown voltage of the first transistor.

4. The low dropout voltage regulator of claim 1, wherein the operational amplifier device comprises an operational amplifier having a first input terminal configured to receive the input voltage, a second input terminal, and an output terminal configured to output the control voltage;

wherein the current split circuit is coupled to the input terminal for receiving the control voltage.

5. The low dropout voltage regulator of claim 1, further comprising:

a second switch having a first terminal coupled to the first voltage terminal, a second terminal coupled to the control terminal of the first transistor, and a control terminal;

wherein:

the first transistor is a P-type transistor;

when a cross voltage between the first terminal and the second terminal of the first transistor is greater than an endurable threshold of the first transistor, the first switch is turned off and the second switch is turned on; and when the cross voltage is smaller than the endurable threshold, the first switch is turned on and the second switch is turned off.

6. The low dropout voltage regulator of claim 1, further comprising:

a second switch having a first terminal coupled to a second voltage terminal, a second terminal coupled to the control terminal of the first transistor, and a control terminal;

wherein:

the first transistor is an N-type transistor;

when a cross voltage between the first terminal and the second terminal of the first transistor is greater than an endurable threshold of the first transistor, the first switch is turned off and the second switch is turned on; and when the cross voltage is smaller than the endurable threshold, the first switch is turned on and the second switch is turned off.

7. The low dropout voltage regulator of claim 1, wherein:

the current split circuit further comprises a third switch having a first terminal coupled to the input terminal, a second terminal coupled to a control terminal of the second transistor, and a control terminal;

when a cross voltage between the first terminal and the second terminal of the first transistor is greater than an endurable threshold of the first transistor, the third switch is turned on; and when the cross voltage is smaller than the endurable threshold, the third switch is turned off.

8. The low dropout voltage regulator of claim 7, wherein:

the current split circuit further comprises a fourth switch having a first terminal coupled to the first voltage terminal, a second terminal coupled to the control terminal of the second transistor, and a control terminal;

the second transistor is a P-type transistor;

when the cross voltage is greater than the endurable threshold, the fourth switch is turned off; and when the cross voltage is smaller than the endurable threshold, the fourth switch is turned on.

9. The low dropout voltage regulator of claim 7, wherein:

the current split circuit further comprises a fourth switch having a first terminal coupled to a second voltage terminal, a second terminal coupled to the control terminal of the second transistor, and a control terminal;

the second transistor is an N-type transistor;

when the cross voltage is greater than the endurable threshold, the fourth switch is turned off; and when the cross voltage is smaller than the endurable threshold, the fourth switch is turned on.

10. The low dropout voltage regulator of claim 1 further comprising a control circuit, wherein:

the control circuit is configured to control the first switch according to an endurable threshold of the first transistor, and one of the output voltage and a cross voltage between the first terminal and the second terminal of the first transistor; or the control circuit is configured to control the first switch according to a current flowing through the regulated voltage output terminal.

11. The low dropout voltage regulator of claim 1, wherein:

the second transistor has a first terminal coupled to the first voltage terminal, a second terminal, and a control terminal coupled to the input terminal; and the current split circuit further comprises a voltage drop element having a first terminal coupled to the second terminal of the second transistor, and a second terminal coupled to the regulated voltage output terminal.

12. The low dropout voltage regulator of claim 11, wherein a channel width-to-length ratio of the first transistor is greater than a channel width-to-length ratio of the second transistor.

13. The low dropout voltage regulator of claim 1, wherein:

the current split circuit further comprises a voltage drop element having a first terminal coupled to the first voltage terminal, and a second terminal; and the second transistor has a first terminal coupled to the second terminal of the voltage drop element, a second terminal coupled to the regulated voltage output terminal, and a control terminal coupled to the input terminal.

14. The low dropout voltage regulator of claim 13, wherein a channel width-to-length ratio of the first transistor is greater than a channel width-to-length ratio of the second transistor.

15. The low dropout voltage regulator of claim 1, wherein a channel length of the second transistor is greater than a channel length of the first transistor.

16. A low dropout voltage regulator comprising:

an operational amplifier device configured to output at least a first control voltage according to an input voltage, a power supply device comprising:

an input terminal configured to receive the first control voltage;

a regulated voltage output terminal configured to output an output voltage;

a first switch having a first terminal coupled to the input terminal, a second terminal, and a control terminal;

a first transistor having a first terminal coupled to a first voltage terminal, a second terminal coupled to the regulated voltage output terminal, and a control terminal coupled to the second terminal of the first switch; and a current split circuit coupled to the first voltage terminal, the operational amplifier device, and the regulated voltage output terminal, and the current split circuit comprising a second transistor coupled between the first voltage terminal and the regulated voltage output terminal; and a feedback circuit coupled to the regulated voltage output terminal and the operational amplifier device.

17. The low dropout voltage regulator of claim 16, wherein:

the operational amplifier device comprises:

a first operational amplifier having a first input terminal configured to receive the input voltage, a second input terminal, and an output terminal configured to output the first control voltage; and a second operational amplifier having a first input terminal configured to receive the input voltage, a second input terminal, and an output terminal coupled to the current split circuit and configured to output a second control voltage to control the current split circuit; and the feedback circuit comprises:

a first feedback unit coupled to the regulated voltage output terminal and the second input terminal of the first operational amplifier; and a second feedback unit coupled to the regulated voltage output terminal and the second input terminal of the second operational amplifier.

18. A power supply device comprising:

an input terminal configured to receive a first control voltage;

a regulated voltage output terminal configured to output an output voltage;

a first switch having a first terminal coupled to the input terminal, a second terminal, and a control terminal;

a first transistor having a first terminal coupled to a first voltage terminal, a second terminal coupled to the regulated voltage output terminal, and a control terminal coupled to the second terminal of the first switch; and a current split circuit coupled to the first voltage terminal and the regulated voltage output terminal, and configured to receive the first control voltage or a second control voltage, the current split circuit comprising a second transistor coupled between the first voltage terminal and the regulated voltage output terminal.

19. The power supply device of claim 18, wherein the first control voltage and the second control voltage are provided by an operational amplifier device, and the output voltage is configured to supply power to a power amplifier.

20. The power supply device of claim 18, wherein:

when a current flowing through the regulated voltage output terminal is greater than a threshold, the first switch is turned on and the output voltage is outputted by at least the first transistor; and when the current flowing through the regulated voltage output terminal is smaller than the threshold, the first switch is turned off and the output voltage is outputted by the current split circuit.

* * * * *